US008260620B2

(12) United States Patent
Ragot et al.

(10) Patent No.: US 8,260,620 B2
(45) Date of Patent: Sep. 4, 2012

(54) DEVICE FOR PERCEPTUAL WEIGHTING IN AUDIO ENCODING/DECODING

(75) Inventors: Stéphane Ragot, Lannion (FR); Romain Trilling, Marnes la Coquette (FR)

(73) Assignee: France Telecom, Paris (FR)

( * ) Notice: Subject to any disclaimer, the term of this patent is extended or adjusted under 35 U.S.C. 154(b) by 1023 days.

(21) Appl. No.: 12/279,493

(22) PCT Filed: Feb. 7, 2007

(86) PCT No.: PCT/FR2007/050760

§ 371 (c)(1),
(2), (4) Date: Aug. 14, 2008

(87) PCT Pub. No.: WO2007/093726

PCT Pub. Date: Aug. 23, 2007

(65) Prior Publication Data

US 2009/0076829 A1 Mar. 19, 2009

(30) Foreign Application Priority Data

Feb. 14, 2006 (FR) ..... 06 50538

(51) Int. Cl.
*G10L 19/00* (2006.01)
*G10L 19/14* (2006.01)

(52) U.S. Cl. ..... 704/500; 704/501; 704/219; 704/225

(58) Field of Classification Search ..... 704/500–504, 704/219, 220, 225
See application file for complete search history.

(56) References Cited

U.S. PATENT DOCUMENTS

| | | | | |
|---|---|---|---|---|
| 5,371,853 | A * | 12/1994 | Kao et al. | 704/200.1 |
| 5,778,335 | A * | 7/1998 | Ubale et al. | 704/219 |
| 6,122,618 | A * | 9/2000 | Park | 704/500 |
| 6,182,031 | B1 * | 1/2001 | Kidder et al. | 704/205 |
| 6,446,037 | B1 * | 9/2002 | Fielder et al. | 704/229 |
| 6,523,003 | B1 * | 2/2003 | Chandran et al. | 704/225 |
| 6,691,082 | B1 | 2/2004 | Aguilar et al. | |
| 6,810,381 | B1 * | 10/2004 | Sasaki et al. | 704/500 |
| 7,177,804 | B2 * | 2/2007 | Wang et al. | 704/219 |

(Continued)

FOREIGN PATENT DOCUMENTS

WO WO 01/73759 10/2001

OTHER PUBLICATIONS

Kataoka et al. "A 16-Kbit/s Wideband Speech Codec Scalable With G.729", EuroSpeech, 1997.*

(Continued)

*Primary Examiner* — Jialong He
(74) *Attorney, Agent, or Firm* — Cozen O'Connor

(57) ABSTRACT

A hierarchical audio coder for use in a frequency band divided into adjacent first and second sub-bands, the coder including: a core coder (305) for coding an original signal in the first sub-band of the frequency band; a stage (306) for calculating a residual signal (e) from the original signal and the signal from the core coder; a device (307) for perceptually weighting the residual signal (e). The perceptual weighting device includes a perceptually weighted filter (307) with gain compensation adapted to realize spectral continuity between the output signal of the perceptually weighted filter with gain compensation and the signal in the second sub-band. Application to transmitting and storing digital signals, such as audio-frequency speech, music, etc. signals.

24 Claims, 8 Drawing Sheets

U.S. PATENT DOCUMENTS

| | | | | |
|---|---|---|---|---|
| 7,277,849 | B2 * | 10/2007 | Streich et al. | 704/229 |
| 7,283,966 | B2 * | 10/2007 | Zhang et al. | 704/500 |
| 7,502,743 | B2 * | 3/2009 | Thumpudi et al. | 704/500 |
| 7,715,573 | B1 * | 5/2010 | Yonemoto et al. | 381/98 |
| 2005/0246178 | A1 * | 11/2005 | Fejzo | 704/500 |

OTHER PUBLICATIONS

Chen et al. "A Low-Delay CELP Coder for the CCITT 16 kb/s Speech Coding Standard", IEEE Journal on Selected Areas in Communications, vol. 10, No. 5, Jun. 1992.*

Koishida et al. "A 16-Kbit/S Bandwidth Scalable Audio Coder Based on the G.729 Standard", IEEE International Conference on Acoustics, Speech, and Signal Processing, 2000 Issue Date: 2000.*

Kovesi et al., "A scalable speech and audio coding scheme with continuous bitrate flexibility", Acoustics, Speech and Signal Processing, 2004, vol. 1, pp. 273-276, May 17, 2004.

Ragot et al., "A 8-32 Kbit/s Scalable Wideband Speech and Audio Coding Candidate for ITU-T G729EV Standardization", Acoustics, Speech and Signal Processing, 2006 IEEE International Conference on Toulouse, France, pp. I-1, May 14, 2006.

* cited by examiner

DEVICE FOR PERCEPTUAL WEIGHTING IN AUDIO ENCODING/DECODING

RELATED APPLICATIONS

This is a U.S. national stage under 35 USC 371 of application No. PCT/FR2007/050760, filed on Feb. 7, 2007.

This application claims the priority of French patent application no. 06/50538 filed Feb. 14, 2006, the content of which is hereby incorporated by reference.

FIELD OF THE INVENTION

The present invention relates to a perceptual weighting device for coding/decoding an audio signal in a given frequency band. It also relates to a hierarchical audio coder and a hierarchical audio decoder comprising a coding/decoding device of the invention.

The invention finds a particularly advantageous application to transmitting and storing digital signals, such as audio-frequency speech, music, etc. signals.

BACKGROUND OF THE INVENTION

There are various techniques for digitizing and compressing audio-frequency speech, music, etc. signals. The commonest methods are:

- "waveform coding" methods such as PCM and ADPCM coding;
- "parametric analysis/synthesis coding" methods, such as code excited linear prediction (CELP) coding;
- "sub-band or transform perceptual coding" methods.

These conventional techniques for coding audio-frequency signals are described in W. B. Kleijn and K. K. Paliwal, Editors, "Speech Coding and Synthesis", Elsevier, 1995.

In this context, the invention more specifically addresses predictive transform coding methods incorporating the CELP coding and transform coding techniques.

In conventional speech coding, the coder generates a bit stream at a fixed bit rate. This fixed bit rate constraint simplifies implementation and use of the coder and of the decoder, commonly referred to in combination as a "codec". Examples of such systems are: the ITU-T G.711 coding system at 64 kilo bits per second (kbps), the UIT-T G.729 coding system at 8 kbps and the GSM-EFR coding system at 12.2 kbps.

However, in some applications, such as mobile telephony, voice over IP, and communication over ad hoc networks, it is preferable to generate a bit stream at a variable bit rate, with bit rates taken from a predefined set. A number of multiple bit rate coding techniques that are more flexible than fixed bit rate coding can therefore be distinguished:

- source and/or channel controlled multimode coding, as used in the AMR-NB, AMR-WB, SMV, and VMR-WB systems;
- hierarchical coding, also known as "scalable" coding, which generates a bit stream that is hierarchical in the sense that it includes a core bit rate and one or more enhancement layers. The G.722 system at 48 kbps, 56 kbps, and 64 kbps is a simple example of bit rate scalable coding. The MPEG-4 CELP codec is scalable in bit rate and in bandwidth; other examples of such coders can be found in the paper by B. Kovesi, D. Massaloux, A. Sollaud, "A Scalable Speech and Audio Coding Scheme with Continuous Bitrate Flexibility", ICASSP 2004;
- multiple description coding.

The present invention relates more particularly to hierarchical coding.

The basic concept of hierarchical, or "scalable", audio coding is illustrated in the paper by Y. Hiwasaki, T. Mori, H. Ohmuro, J. Ikedo, D. Tokumoto, and A. Kataoka, "Scalable Speech Coding Technology for High-Quality Ubiquitous Communications", NTT Technical Review, March 2004, for example.

In this type of coding, the bit stream includes a base layer or core layer and one or more enhancement layers. The base layer is generated by a codec known as the core "codec" at a low fixed bit rate that guarantees some minimum level of coding quality and that must be received by the decoder in order to maintain an acceptable level of quality.

The enhancement layers are used to enhance quality; they may not all be received by the decoder. The main benefit of hierarchical coding is that the bit rate can be adapted simply by truncating the bit stream. The possible number of layers, i.e. the possible number of truncations of the bit stream, defines the coding granularity: in strong granularity coding the bit stream includes few layers (of the order of 2 to 4 layers), whereas fine granularity coding provides an increment of the order of 1 kbps, for example.

The invention relates more particularly to bit rate and bandwidth scalable coding techniques using a CELP type core coder in the telephone band and one or more wide band enhancement layers. Examples of such systems are given in the paper by H. Taddéi et al., "A Scalable Three Bitrate (8, 14.2, and 24 kbps) Audio Coder", $107^{th}$ Convention AES, 1999, with coarse granularity of 8 kbps, 14.2 kbps, and 24 kbps, and the aforementioned paper by B. Kovesi et al refers to a fine granularity of 6.4 kbps to 32 kbps.

In 2004 the ITU-T launched a standardized hierarchical core coder project. This G.729EV coder (EV standing for "embedded variable bitrate") is an add-on the known G.729 coder. The objective of the G.729EV standard is to obtain a G.729 core hierarchical coder producing a signal with a band that extends from the narrow band (300 hertz (Hz) to 3400 Hz) to the wide band (50 Hz to 7000 Hz) at a bit rate of 8 kbps to 32 kbps for conversation services. This coder is inherently capable of interworking with the G.729 recommendation, which ensures compatibility with existing voice over IP equipment.

The 8 kbps to 32 kbps hierarchical audio coder shown in FIG. 1 was proposed in response to the above project and is described in the ITU-T document COM 16, D135 (WP 3/16), "France Telecom G.729EV Candidate: High level description and complexity evaluation", Q.10/16, Study Period 2005-2008, Geneva, 26 Jul.-5 Aug. 2005. This coder effects three-layer coding, comprising cascade CELP coding, band expansion by full band linear predictive coding (LPC) and predictive transform coding. TDAC (time domain aliasing cancellation) coding is applied following application of the modified discrete cosine transform (MDCT). The predictive transform coding layer uses a full band perceptually weighted filter $\hat{W}_{WB}(z)$.

The concept of shaping coding noise by perceptually weighted filtering is explained in the aforementioned publication by W. B. Kleijn et al. In substance, perceptually weighted filtering shapes the coding noise by attenuating the signal at the frequency at which the noise intensity is high and at which noise can be masked more easily.

The perceptually weighted filters most widely used in narrow-band CELP coding are of the form $\hat{A}(z/\gamma_1)/\hat{A}(z/\gamma_2)$ where $0 \leqq \gamma_2 \leqq \gamma_1 < 1$ and $\hat{A}(z)$ represents the LPC spectrum of a signal segment with a length of 5 milliseconds (ms) to 30 ms. Thus analysis by synthesis in CELP coding amounts to minimizing the quadratic error in a signal domain weighted perceptually by this type of filter.

However, this technique as proposed in the context of G.729EV standardization has the drawback of using a full band perpetual weighting filter. The associated filtering is relatively complex in terms of calculation time.

SUMMARY OF THE INVENTION

One object of the present invention is to provide a perceptual weighting device for coding/decoding an audio signal in a given frequency band that provides full band perceptually weighted filtering, i.e. over the whole of said given frequency band, in particular the wide band 0 to 8000 Hz of a hierarchical audio coder, without this operation leading to long calculations that are costly in terms of resources.

This and other objects are attained in accordance with one aspect of the present invention directed to such a perceptual weighting device, with coding/decoding being effected in a plurality of adjacent sub-bands in said given frequency band, wherein said device includes, in at least one sub-band, a perceptually weighted filter with gain compensation adapted to realize spectral continuity between the output signal of said perceptually weighted filter with gain compensation and the signals in the sub-bands adjacent to said sub-band.

Thus, a perceptual weighting device according to an embodiment of the invention effects the required filtering over one or more sub-bands and not over the whole of the coding/decoding band, which limits the complexity of the calculations. Moreover, any disparity from one sub-band to another between the gains of perceptually weighted filtering is eliminated by gain compensation, which ensures spectral continuity over the entire frequency band. The invention therefore produces a homogeneous band after perceptually weighted filtering even if the sub-bands that constitute it are from this point of view processed separately.

A particularly important advantage of this is that full-band transform coding can be applied over sub-bands that would otherwise not be homogeneous because they would be filtered separately.

Of course, each sub-band can be filtered with perceptual weighting or not. Spectral continuity can thus be provided between a filtered sub-band and another, non-filtered sub-band or between two filtered sub-bands.

In one embodiment, said perceptually weighted filter with gain compensation includes a perceptually weighted filter and a gain compensation module.

In another embodiment, said perceptually weighted filter with gain compensation includes a perceptually weighted filter incorporating gain compensation.

Said perceptually weighted filter in the first sub-band can then be of the form $\hat{A}(z/\gamma_1)/\hat{A}(z/\gamma_2)$ where $\hat{A}(z)$ represents a linear prediction filter. In this situation, the invention teaches that said gain compensation should effect multiplication by a factor fac defined below, where $\hat{a}_i$ are the coefficients of the linear prediction filter $\hat{A}(z)$:

$$fac = \left| \frac{\sum_{i=0}^{p} (-\gamma_2)^i \hat{a}_i}{\sum_{i=0}^{p} (-\gamma_1)^i \hat{a}_i} \right|$$

A linear prediction filter $\hat{A}(z)$ of order p and with coefficients $\hat{a}_i$ is defined as follows:

$$\hat{A}(z)=\hat{a}_0+\hat{a}_1 z^{-1}+\hat{a}_2 z^{-2}+\ldots+\hat{a}_p z^{-p}$$

Another aspect of the invention relates to a hierarchical audio coder for use in a frequency band divided into adjacent first and second sub-bands, said coder comprising:

a core coder for coding an original signal in a first sub-band of said frequency band;

a stage for calculating a residual signal from said original signal and the signal from said core coder;

a device for perceptually weighting said residual signal;

noteworthy in that said perceptual weighting device includes a perceptually weighted filter with gain compensation adapted to realize spectral continuity between the output signal of said perceptually weighted filter with gain compensation and the signal in the second sub-band.

In this embodiment, only the first sub-band is subjected to perceptually weighted filtering, and the second sub-band is not filtered.

Moreover, if said gain compensated perceptually weighted filter includes a perceptually weighted filter in the first sub-band, the invention teaches that said perceptually weighted filter in the first sub-band is of the form $\hat{A}_1(z/\gamma_1)/\hat{A}_1(z/\gamma_2)$ where $\hat{A}_1(z)$ represents a linear prediction filter. In this situation, gain compensation in the first sub-band effects a multiplication by a factor $fac_1$ equal to:

$$fac_1 = \left| \frac{\sum_{i=0}^{p} (-\gamma_2)^i \hat{a}_i}{\sum_{i=0}^{p} (-\gamma_1)^i \hat{a}_i} \right|$$

where $\hat{a}_i$ are the coefficients of the linear prediction filter $\hat{A}_1(z)$.

Advantageously, the signal from the perceptual weighting device in the first sub-band and the original signal in the second sub-band are applied to respective transform analysis modules and said transform analysis modules are connected to a transform coder in said frequency band.

In a variant of the hierarchical audio coder of the invention, said coder also includes a perceptual weighting device for perceptually weighting the original signal in the second sub-band, comprising a perceptually weighted filter with gain compensation adapted to realize spectral continuity between the output signal of said perceptually weighted filter with gain compensation and the output signal of the perceptual weighting device in the first sub-band.

Thus this is a coder for which perceptually weighted filtering is effected separately in the two sub-bands.

If said perceptually weighted filter with gain compensation includes a perceptually weighted filter in the second band, said perceptually weighted filter in the second sub-band is of the form $\hat{A}_2(z/\gamma'_1)/\hat{A}_2(z/\gamma'_2)$ where $\hat{A}_2(z)$ represents a linear prediction filter. In this example, said gain compensation in the second sub-band effects multiplication by a factor $fac_2$ equal to:

$$fac_2 = \left| \frac{\sum_{i=0}^{p} (\gamma'_2)^i \hat{a}'_i}{\sum_{i=0}^{p} (\gamma'_1)^i \hat{a}'_i} \right|$$

in which the $\hat{a}'_i$ are the coefficients of said linear prediction filter.

The signal from the perceptual weighting device in the first sub-band and the signal from the perceptual weighting device in the second sub-band are advantageously applied to respective transform analysis modules and said transform analysis modules are connected to a transform coder in said frequency band.

The invention further relates to a hierarchical audio decoder for use in a frequency band divided into adjacent first and second sub-bands, said decoder comprising:

a core decoder adapted to decode in the first sub-band of said frequency band a received signal coded by the coder according to the invention;

an inverse perceptual weighting device for inversely perceptually weighting a signal representing the residual signal weighted in the first sub-band by the perceptual weighting device of said coder;

noteworthy in that said inverse perceptual weighting device includes a perceptually weighted filter with gain compensation that is the inverse of the perceptually weighted filter with gain compensation of the coder in the first sub-band.

In an alternative embodiment of the invention said decoder also includes an inverse perceptual weighting device of the decoded signal in the second sub-band, comprising a perceptually weighted filter with gain compensation that is the inverse of the perceptually weighted filter with gain compensation of the coder in the second sub-band.

In this latter situation, if said perceptually weighted filter with gain compensation includes a perceptually weighted filter in the second band, said inverse perceptually weighted filter with gain compensation includes an inverse perceptually weighted filter in the second sub-band. In particular, said inverse perceptually weighted filter in the second sub-band is of the form $\hat{A}_2(z/\gamma'_2)/\hat{A}_2(z/\gamma'_1)$ and the coefficients of the linear prediction filter $\hat{A}_2(z)$ are supplied by a band expansion module.

Another aspect of the invention relates to a perceptual weighting method of coding an audio signal in a given frequency band, noteworthy in that, said coding being effected in a plurality of adjacent sub-bands in said frequency band, said method includes, in at least one sub-band, a step of perceptual weighting with gain compensation adapted to realize spectral continuity between the signal from said perceptual weighting step with gain compensation and the signals in the sub-bands adjacent to said sub-band.

Another aspect of the invention relates to a method of perceptual weighting for decoding an audio signal coded in a given frequency band according to the method of perceptual weighting used to code said signal noteworthy in that said method includes in said sub-band, a step of perceptual weighting with gain compensation that is the inverse of said perceptual weighting step with gain compensation.

BRIEF DESCRIPTION OF THE DRAWINGS

The following description with reference to the appended drawings, is provided by way of non-limiting example to clearly explain the invention and how it can be reduced to practice.

DETAILED DESCRIPTION OF THE DRAWINGS

Figure 2:
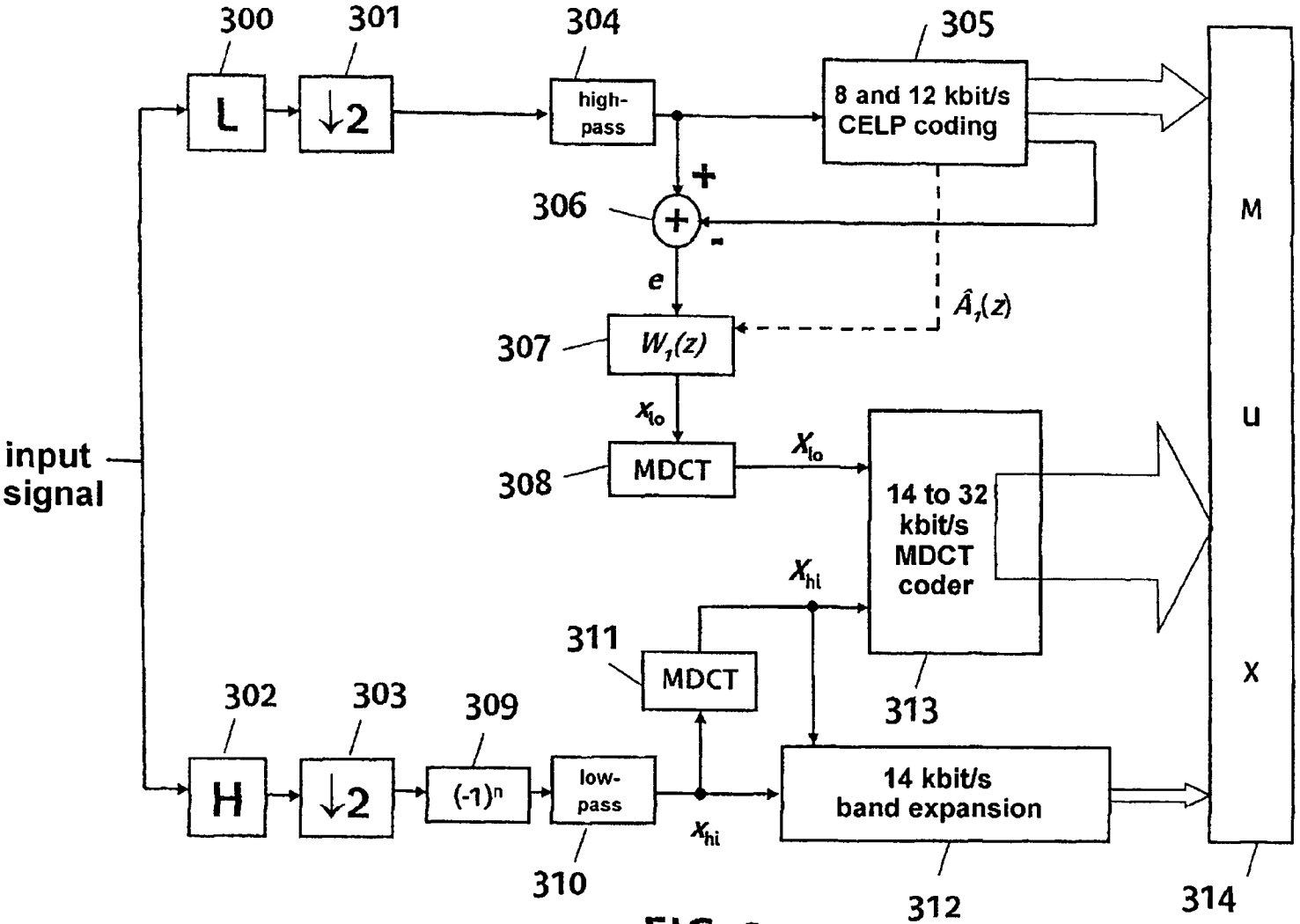
FIG. 2 is a high-level diagram of a hierarchical audio coder of the invention.

FIG. 2 shows a sub-band hierarchical audio coder for bit rates from 8 kbps to 32 kbps. This figure shows the various steps of the corresponding coding method.

The input signal in a "wide" frequency band from 50 Hz to 7000 Hz and sampled at 16 kHz is first divided into two adjacent sub-bands by a quadrature mirror filter (QMF). The first sub-band, from 0 to 4000 Hz, also known as the low band, is obtained by low-pass (L) filtering 300 and decimation 301 and the second sub-band, from 4000 Hz to 8000 Hz, also known as the high band, by high-pass (H) filtering 302 and decimation 303. In a preferred embodiment, the L filter 300 and the H filter 302 are of length 64 and are as described in the paper by J. Johnston, "A filter family designed for use in quadrature mirror filter banks", ICASSP, vol. 5, pp. 291-294, 1980.

Figure 1:
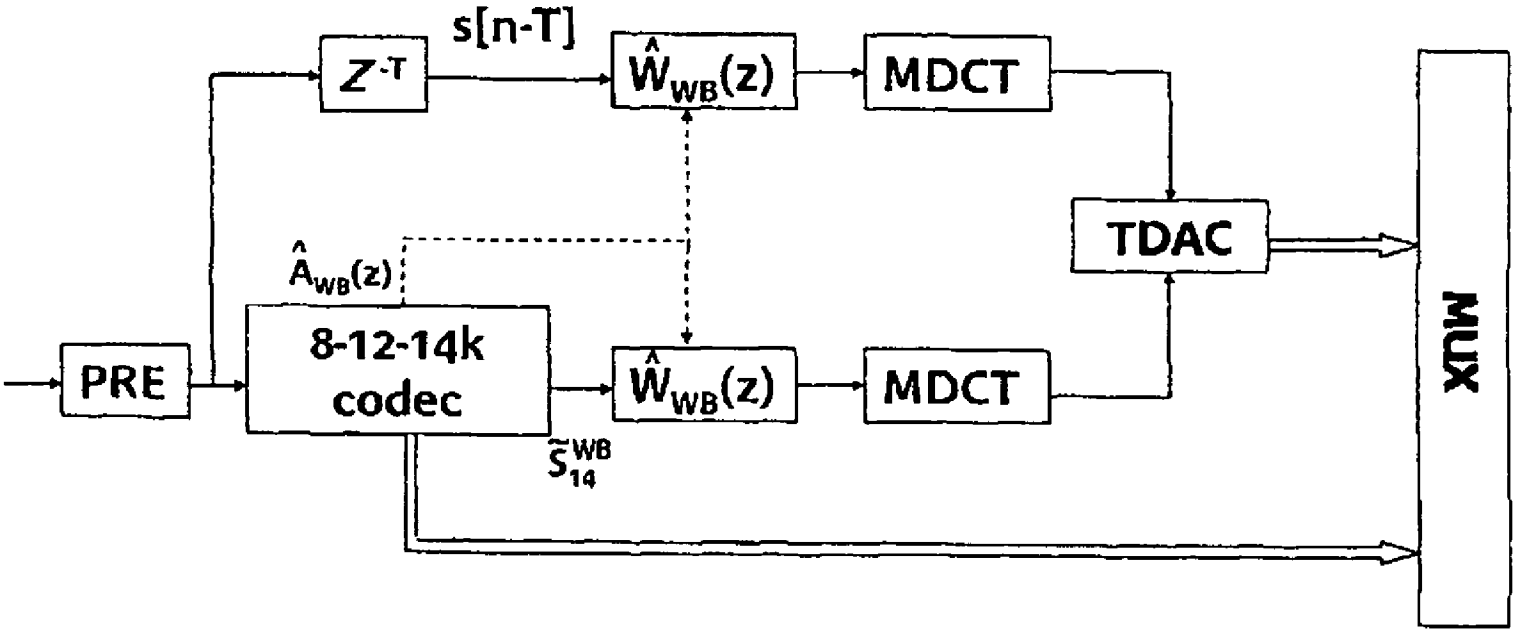
FIG. 1 (prior art)
FIG. 1 is a diagram of a prior art hierarchical audio coder, carrying out full band perceptually weighted filtering prior to transform coding.

The first sub-band is pre-processed by a high-pass filter 304 eliminating components below 50 Hz before coding by a narrow band CELP core coder 305. The high-pass filtering takes account of the fact that the wide band is defined as covering the range 50 Hz to 7000 Hz. In this embodiment, narrow band CELP coding corresponds to that shown in FIG. 1 and consists of cascade CELP coding using a modified G.729 coding first stage (ITU-T Recommendation G.729, "Coding of Speech at 8 kbps using Conjugate Structure Algebraic Code Excited Linear Prediction (CS-ACELP)", March 1996) with no pre-processing filter, and a second stage consisting of a additional fixed dictionary. The residual signal e linked to the error caused by CELP coding is calculated by the stage 306 and then weighted perceptually by a device 307 comprising a perceptually weighted filter to obtain the time-domain signal $x_{lo}$ that is analyzed using the modified discrete cosine transform (MDCT) 308 to obtain the discrete spectrum $X_{lo}$ in the frequency domain.

Figure 3:
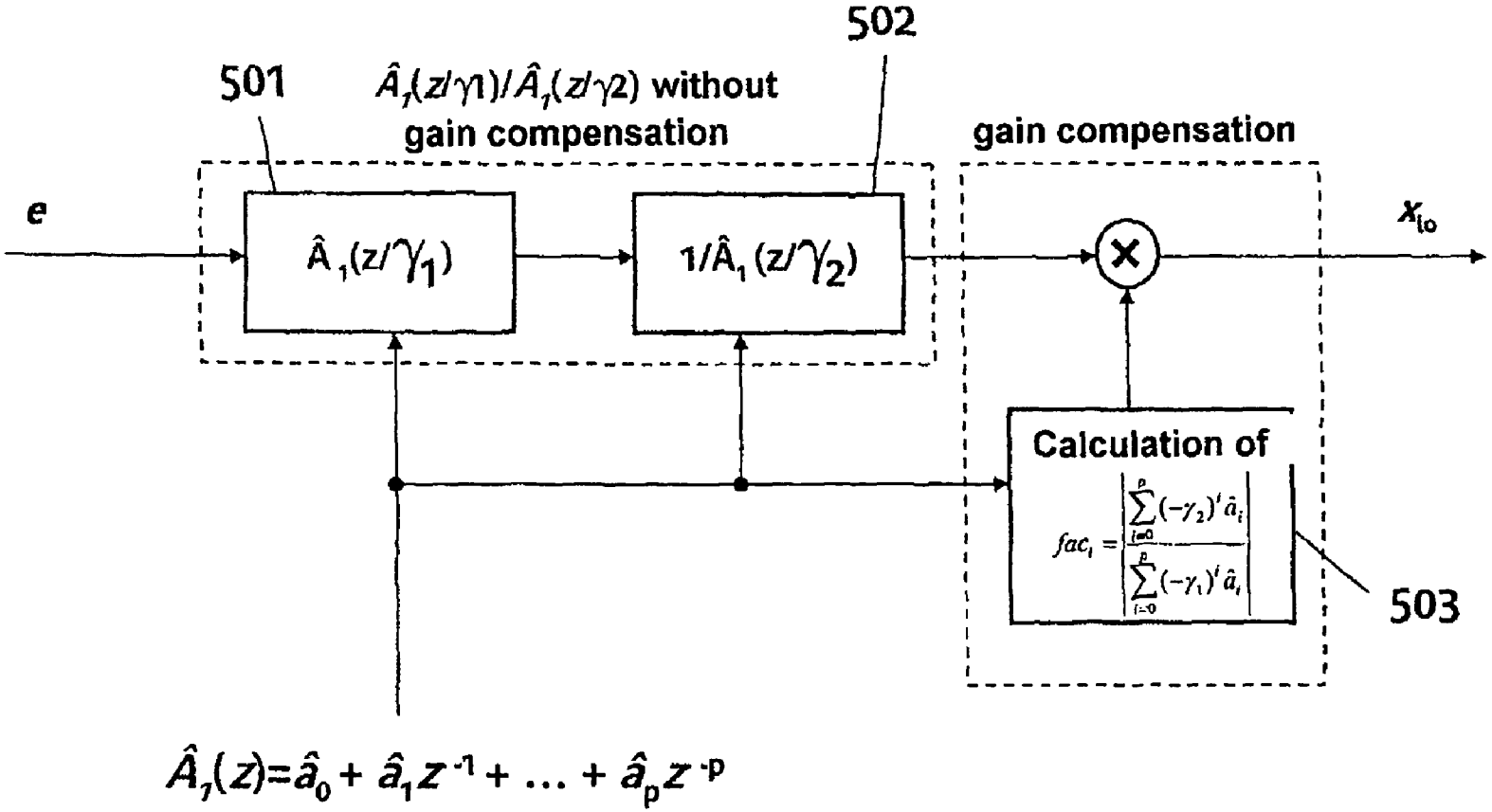
FIG. 3 is a diagram of the perceptual weighting device of the FIG. 2 coder.

FIG. 3 shows the perceptual weighting device 307, which $W_1(z)$ includes a perceptually weighted filter $\hat{A}_1(z/\gamma_1)/\hat{A}_1(z/\gamma_2)$ comprising $\hat{A}_1(z/\gamma_1)$ and $1/\hat{A}_1(z/\gamma_2)$ filtering stages 501 and 502, respectively. As shown in FIG. 2, the linear prediction filter $\hat{A}_1(z)$ is based on narrow band CELP coding. The perceptual weighting device 307 also includes a gain compensation module 503 for multiplying the perceptually weighted signal coming from the filter 501, 502 by the factor $fac_1$ defined as follows:

$$fac_1 = \left| \frac{\sum_{i=0}^{p} (-\gamma_2)^i \hat{a}_i}{\sum_{i=0}^{p} (-\gamma_1)^i \hat{a}_i} \right|$$

in which $\hat{a}_i$ are the coefficients of the filter $\hat{A}_1(z)$:

$$\hat{A}_1(z)=\hat{a}_0+\hat{a}_1z^{-1}+\hat{a}_2z^{-2}+\ldots+\hat{a}_pz^{-p}$$

In a preferred embodiment, the coefficients $\hat{a}_i$ are updated in each 5 ms sub-frame, $\gamma_1=0.96$, and $\gamma_2=0.6$.

An equivalent definition of the factor $fac_1$ corresponds to the reciprocal of the gain of the filter $\hat{A}_1(z/\gamma_1)/\hat{A}_1(z/\gamma_2)$ at the Nyquist frequency (4 kHz), that is to say, for z=−1:

$$fac_1=1/|\hat{A}_1(z/\gamma_1)/\hat{A}_1(z/\gamma_2)|$$

Spectral aliasing cancellation 309 in the second sub-band, or high band, is effected first to compensate aliasing caused by high-pass filtering 302 in combination with decimation 303. This high band is then pre-processed by a low-pass filter 310 eliminating components in the original signal between 7000 and 8000 Hz. The MDCT transform 311 is then applied to the resulting signal $x_{hi}$ in the time domain to obtain the discrete spectrum $X_{hi}$ in the frequency domain. Band expansion 312 is then based on $x_{hi}$ and $X_{hi}$.

The signals $x_{lo}$ and $x_{hi}$ are divided into frames of N samples and the MDCT transform of length L=2N analyses the current and future frames. In a preferred embodiment, $x_{lo}$ and $x_{hi}$ are narrow-band signals sampled at 8 kHz and N=160 (20 ms). The MDCT transforms $X_{lo}$ and $x_{hi}$ therefore include N 160 coefficients, each coefficient representing a frequency band of 4000/160=25 Hz. In a preferred embodiment, the MDCT transform is implemented by the algorithm described by P. Duhamel, Y. Mahieux, J. P. Petit, "A fast algorithm for the implementation of filter banks based on time domain aliasing cancellation", ICASSP, vol. 3, pp. 2209-2212, 1991.

The low-band and high-band MDCT spectra $X_{lo}$ and $X_{hi}$ are coded in the transform coding module 313.

The bit streams generated by the coding modules 305, 312, and 313 are multiplexed and structured into a hierarchical bit stream in the multiplexer 314.

Coding is effected by 20 ms frames (i.e. blocks of 320 samples). The coding bit rate is 8 kbps, 12 kbps, 14 kbps to 32 kbps.

The benefit of the perceptual weighting step with gain compensation by the factor $fac_1$ is explained below with reference to FIG. 4.

That figure shows the division of the total frequency band into a first sub-band, i.e. the low band from 0 to 4 kHz, and a second sub-band, i.e. the high band from 4 to & kHz. In a preferred embodiment, the MDCT coder 313 is applied to these two sub-bands, with:

- perceptually weighted filtering $W_1(z)$ and gain compensation prior to application of the MDCT transform in the low band;
- application of the direct MDCT transform in the high band without perceptually weighted filtering.

Figure 4:
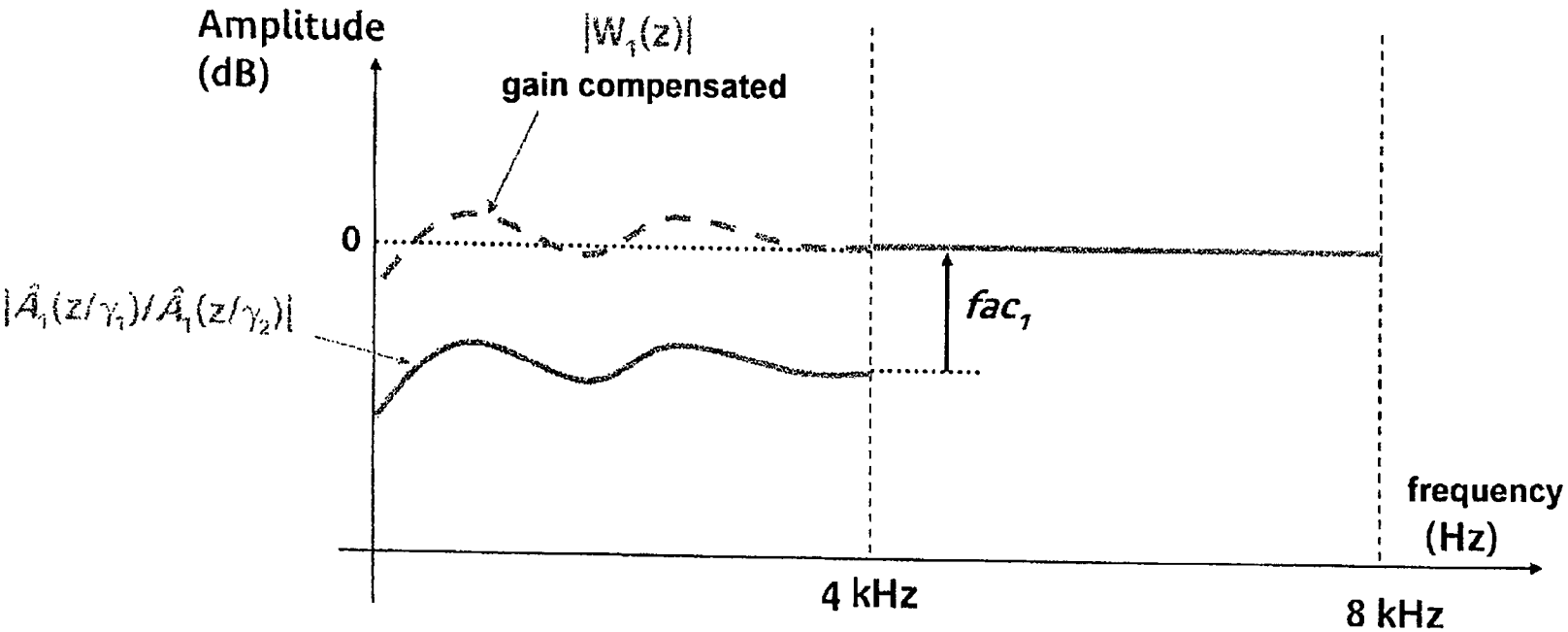
FIG. 4 shows a spectrum showing the amplitude of a signal filtered and then gain compensated in accordance with the invention in a first sub-band and the amplitude of an unfiltered signal in a second sub-band.

These two operations in the sub-bands are shown diagrammatically in FIG. 4 by the amplitude response of $\hat{A}_1(z/\gamma_1)/\hat{A}_1(z/\gamma_2)$ in the low band and a flat response at 0 dB in the high band, respectively. The latter flat response shows that no processing is applied in the high band before applying the MDCT transform. Gain compensation by the factor $fac_1$ shifts the amplitude response of $\hat{A}_1(z/\gamma_1)/\hat{A}_1(z/\gamma_2)$ to ensure continuity at 4 kHz. This continuity is very important because it subsequently enables conjoint homogeneous coding of the two discrete spectra $x_{lo}$ and $x_{hi}$ into a single vector X, which therefore represents a full-band discrete spectrum.

It is important to note that the value 0 dB used here to define the continuity between the low and high bands is merely illustrative.

Figure 5:
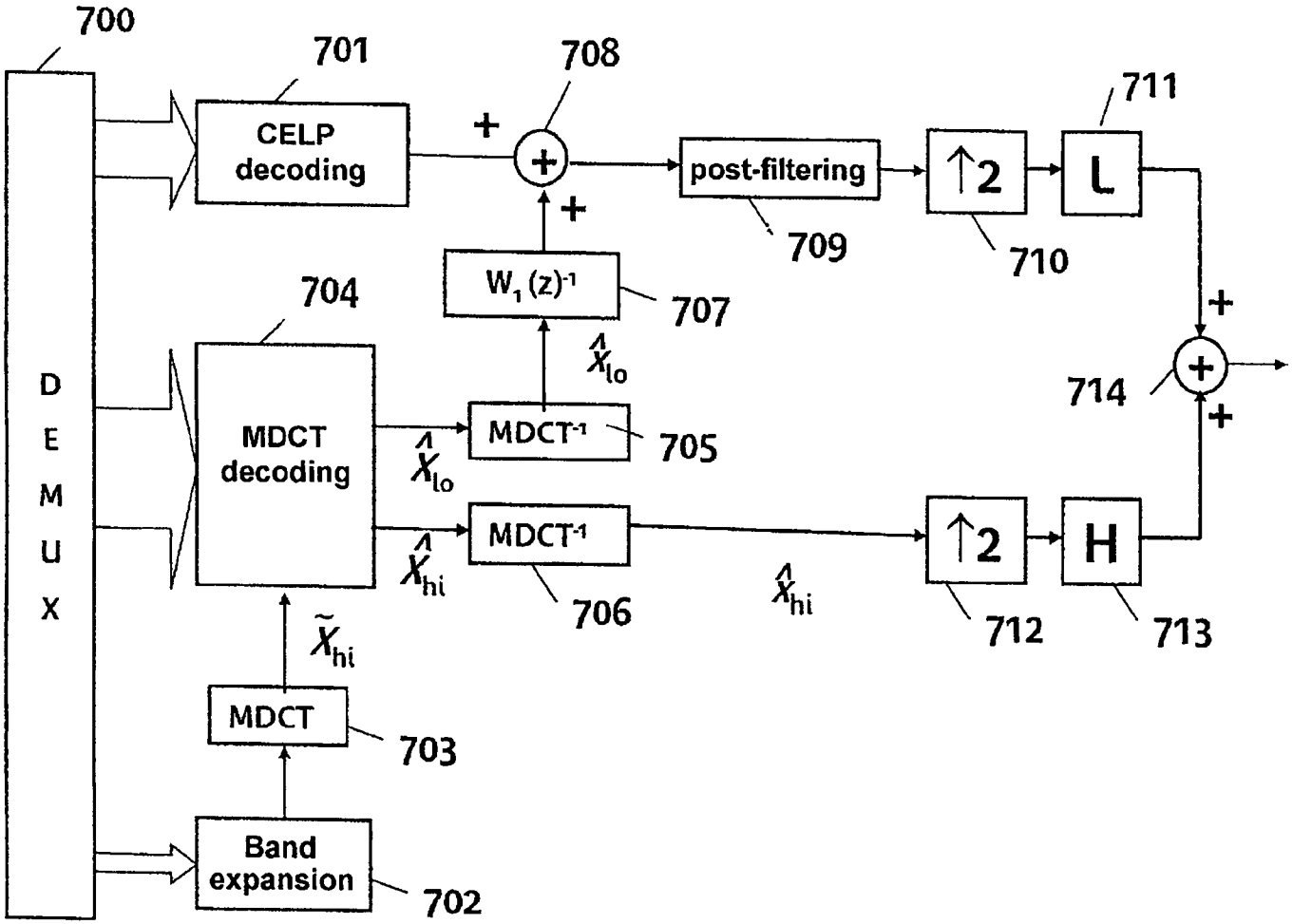
FIG. 5 is a high-level diagram of a hierarchical audio decoder of the invention.

The hierarchical audio decoder associated with the coder that has just been described with reference to FIGS. 2, 3, and 4 is shown in FIG. 5, which shows the steps of decoding the signal coded by said coder.

The bits defining each 20 ms frame are demultiplexed in the demultiplexer 700. Decoding at 8 kbps to 32 kbps is described below, although in practice the bit stream can be truncated to 8 kbps, 12 kbps, 14 kbps or between 14 kbps and 32 kbps.

The bit stream of the layers at 8 kbps and 12 kbps is used by the CELP decoder 701 to generate a first synthesis in the first sub-band (the narrow band) from 0 to 4000 Hz. The portion of the bit stream associated with the layer at 14 kbps is decoded by the band expansion module 702 and the MDCT transform 703 is applied to the signal obtained in the second sub-band (the high band) from 4000 Hz to 7000 Hz to yield a spectrum $\tilde{X}_{hi}$. MDCT decoding 704 generates from the bit stream associated with the bit rates from 14 kbps to 32 kbps a reconstructed spectrum $\tilde{X}_{lo}$ in the low band and a reconstructed spectrum $\tilde{X}_{hi}$ in the high band. These two spectra are converted to time-domain signals $\tilde{x}_{lo}$ and $\tilde{x}_{hi}$ by applying the inverse MDCT transform in the blocks 705 and 706. The signal $\tilde{x}_{lo}$ is added to the CELP synthesis by the adder 708 after filtering by an inverse perceptual weighting device 707. The result is then post-filtered at 709.

The output signal in the wide band, sampled at 16 kHz, is obtained by means of a synthesis QMF filter bank applying oversampling (710 and 712), low-pass filtering (711), high-pass filtering (713), and summation (714).

A step of perceptual decoding with gain compensation is effected by the inverse perceptual weighting device 707 $W_1(z)^{-1}$ including an inverse perceptually weighted filter $\hat{A}_1(z/\gamma_2)/\hat{A}\hat{A}_1(z/\gamma_1)$ and a gain compensation module for multiplying the signal from said inverse perceptually weighted filter by the factor $1/fac_1$:

$$1/fac_1=\left|\frac{\sum_{i=0}^{p}(-\gamma_1)^i\hat{a}_i}{\sum_{i=0}^{p}(-\gamma_2)^i\hat{a}_i}\right|$$

in which $\hat{a}_i$ are the coefficients of the filter $\hat{A}_1(z)$ resulting from CELP coding in the narrow band. As in the coder, the coefficients $\hat{a}_i$ are maintained constant in each 5 ms sub-frame.

Figure 6:
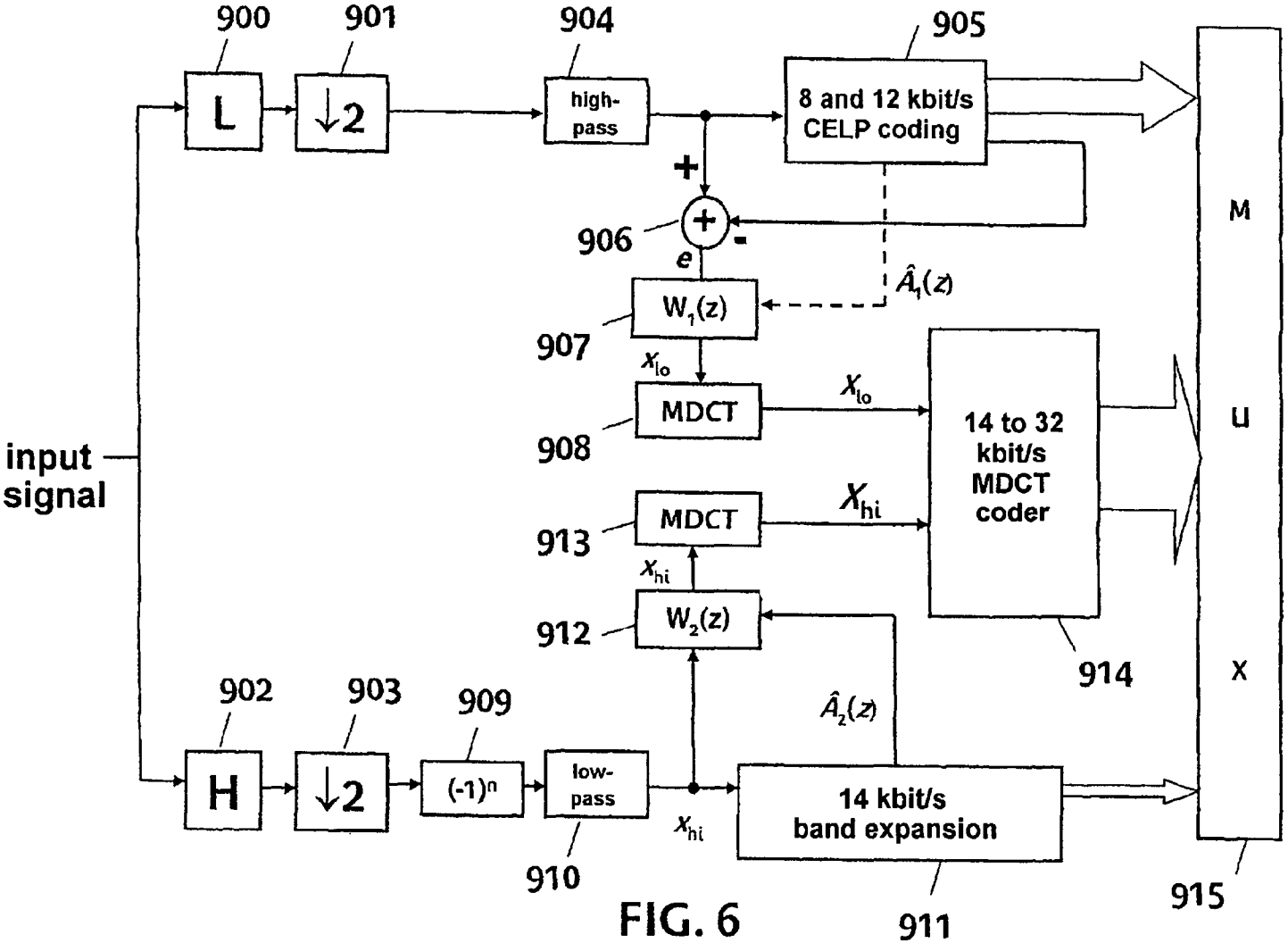
FIG. 6 a diagram of a variant of the FIG. 2 hierarchical audio coder.

FIG. 6 shows a variant of the FIG. 2 embodiment of the coder.

This figure shows the analysis filter bank 900 to 903, processing of the low band by the blocks 904 to 908, pre-processing of the high band by the blocks 909 to 910, the MDCT coder 913, and the multiplexer 915.

The main difference between this variant and the FIG. 2 embodiment is the incorporation of linear prediction (LPC) analysis and quantization in the second sub-band (the high band). The LPC coefficients quantized in the high band, $\hat{A}_2(z)$ are supplied by the band expansion module 911. LPC-based band expansion is not described in detail here as it is outside the scope of the invention. These LPC coefficients enable application of perceptually weighted filtering with gain compensation $W_2(z)$ in the device 912 before applying the MDCT transform 913. Accordingly, this variant amounts to perceptual weighting of the difference signal e in the low band and the signal $x_{hi}$ in the high band, whereas the embodiment described previously perceptually weights only the difference signal e in the low band.

In this variant, the perceptual weighting device 912 with gain compensation $W_2(z)$ in the high band takes the same form as the filter $W_1(z)$ in the low band. It is therefore a filter of the type $\hat{A}_2(z/\gamma'_1)/\hat{A}_2(z/\gamma'_2)$ followed by a gain compensation factor $fac_2$ defined as follows:

$$fac_2 = \left| \frac{\sum_{i=0}^{p} (\gamma'_2)^i \hat{a}'_i}{\sum_{i=0}^{p} (\gamma'_1)^i \hat{a}'_i} \right|$$

in which the $\hat{a}'_i$ are the coefficients of the filter $\hat{A}_2(z)$:

$$\hat{A}_2(z)=\hat{a}'_0+\hat{a}'_1z^{-1}+\hat{a}'_2z^{-2}+\ldots+\hat{a}'_pz^{-p}$$

and $\gamma'_1=0.96$ and $\gamma'_2=0.6$.

This factor corresponds to:

$$fac_2=1/|\hat{A}_2(z/\gamma'_1)/\hat{A}_2(z/\gamma'_2)|$$

for z=1, i.e. the frequency 0 Hz or the DC component in the high band that in fact corresponds to 4 kHz once that frequency reverts to that of the input signal before QMF filtering.

Figure 8:
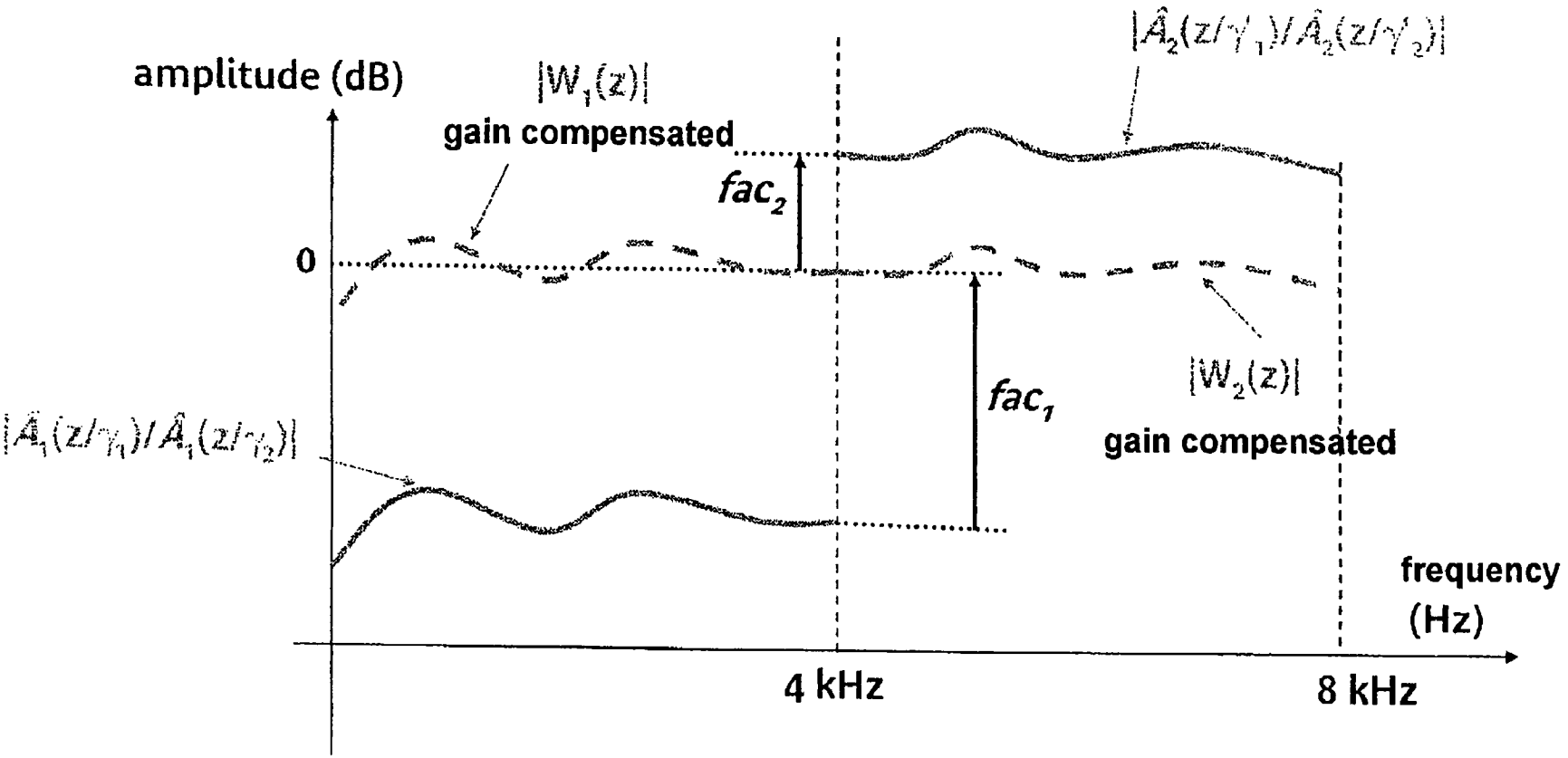
FIG. 8 shows a spectrum showing the amplitude of a signal filtered and then gain compensated in accordance with the invention in a first sub-band and the amplitude of a signal filtered and then equalized in accordance with the invention in a second sub-band.

The benefit of perceptual weighting with gain compensation in the two sub-bands is explained with reference to FIG. 8, which shows division into a low band (0 to 4 kHz) and a high band (4 kHz to 8 kHz). In the variant considered here, the MDCT coder is applied to these two sub-bands, with:

filtering $W_1(z)$ before MDCT in the low band;

filtering $W_2(z)$ before MDCT in the high band.

These two sub-band operations are represented by the amplitude response of $\hat{A}_1(z/\gamma_1)/\hat{A}_1(z/\gamma_2)$ in the low band and the amplitude response of $\hat{A}_2(z/\gamma'_1)/\hat{A}_2(z/\gamma'_2)$ in the high band, respectively.

Gain compensation in the low and high bands by the respective factors $fac_1$ and $fac_2$ ensures continuity of the responses of the filters at 4 kHz. It is this continuity that enables the two discrete spectra $X_{lo}$ and $X_{hi}$ to be coded afterwards in a single vector. Again, it is important to note that the value 0 dB used here to define the continuity between low and high bands is merely illustrative.

Figure 7:
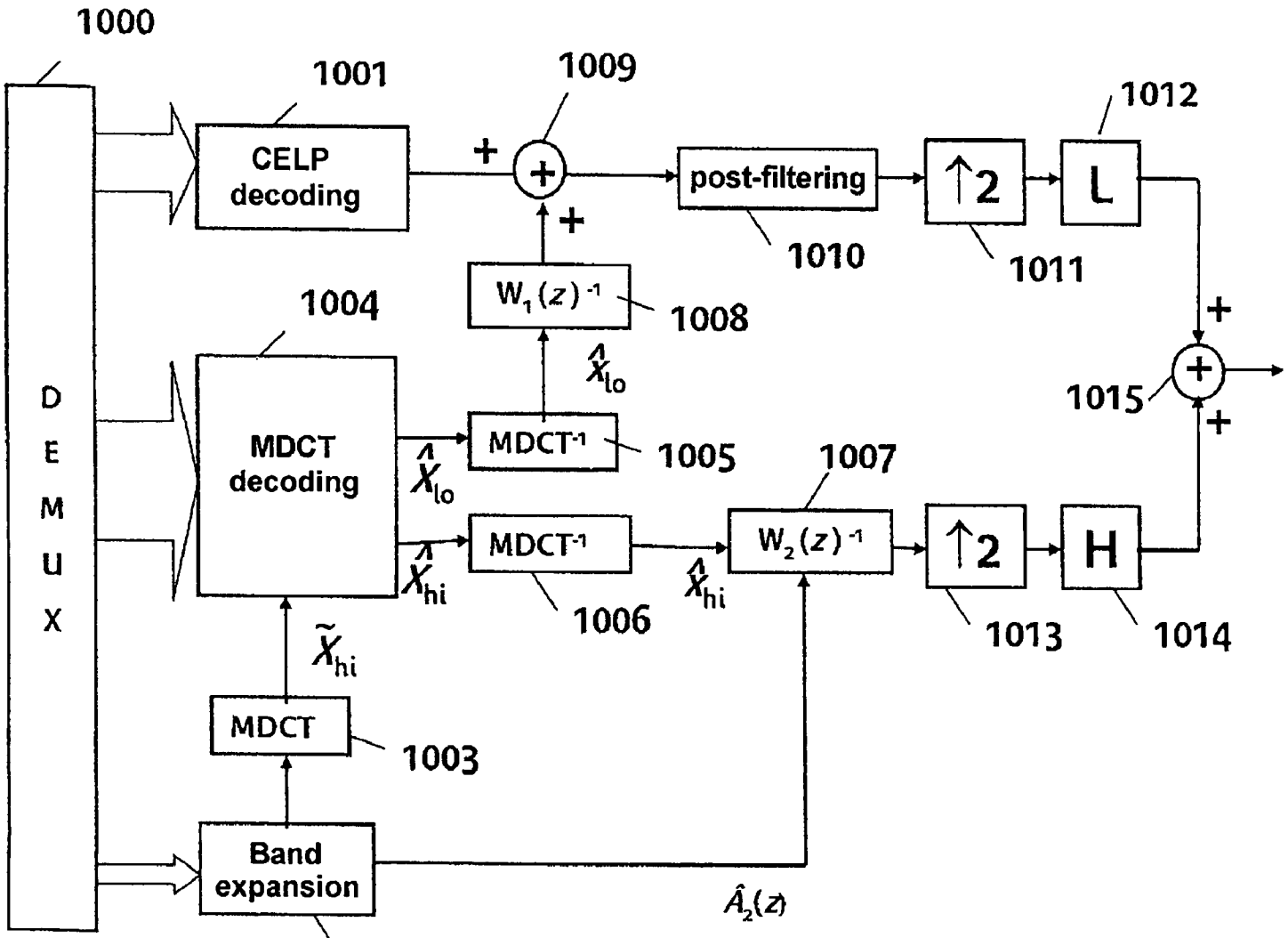
FIG. 7 a diagram of a variant of the FIG. 5 hierarchical audio decoder.

The hierarchical audio decoder corresponding to this variant is shown in FIG. 7. The only difference compared to the decoder of the previous embodiment is the recovery of the quantized LPC coefficients $\hat{A}_2(z)$ used by the band expansion module 1002 and application of an inverse perceptually weighted filter $W_2(z)^{-1}$ to the signal $\hat{x}_{hi}$. The inverse filtering $W_2(z)^{-1}$ used in the high band is of the $\hat{A}_2(z/\gamma'_2)/\hat{A}_2(z/\gamma'_1)$ type followed by gain compensation by the factor $1/fac_2$ where $fac_2$ is as defined above.

The invention also covers a computer program including a series of instructions stored on a medium for execution by a computer or a dedicated device, noteworthy in that execution of those instructions executes the perceptual weighting method of the invention for coding and/or decoding.

The aforementioned computer program is a directly executable program, for example, installed in a perceptual weighting device of the invention.

Of course, the invention is not limited to the embodiments that have just been described. Note in particular that:

the numerical values of the parameters $\gamma_1$, $\gamma_2$, $\gamma'_1$, and $\gamma'_2$ can be different from those chosen above;

the compensation factor can be applied before $\hat{A}(z/\gamma_1)/\hat{A}(z/\gamma_2)$ filtering or between $\hat{A}(z/\gamma_1)$ and $\hat{A}(z/\gamma_2)$ filtering or integrated into $\hat{A}(z/\gamma_1)$ or $\hat{A}(z/\gamma_2)$ filtering; the same applies to the factor $fac_2$ and the corresponding inverse filters;

the perceptually weighted filter is not necessarily of the form $\hat{A}(z/\gamma_1)/\hat{A}(z/\gamma_2)$;

more than two sub-bands can be defined in the total frequency band.

The invention claimed is:

1. A perceptual weighting device for coding/decoding of an audio signal in a given frequency band, said coding/decoding being effected in a plurality of adjacent sub-bands in said given frequency band, wherein said device includes, in at least one sub-band of the plurality of adjacent sub-bands, a perceptually weighted filter with gain compensation, said perceptually weighted filter with gain compensation being in the form of $fac*\hat{A}(z/\gamma_1)/\hat{A}(z/\gamma_2)$ where $\hat{A}(z)$ represents a linear prediction filter, with $0\leqq\gamma_2\leqq1$ and $0\leqq\gamma_1\leqq1$, and fac represents a gain compensation factor which is a function of coefficients of said linear prediction filter $\hat{A}(z)$, the gain compensation being adapted to realize spectral continuity between an output signal of said perceptually weighted filter with gain compensation and signals in sub-bands adjacent to said at least one sub-band, said gain compensation factor fac being given by:

$$fac = \left| \frac{\sum_{i=0}^{p} (-\gamma_2)^i \hat{a}_i}{\sum_{i=0}^{p} (-\gamma_1)^i \hat{a}_i} \right|$$

where $\hat{a}_i$ are the coefficients of said linear prediction filter $\hat{A}(z)=\hat{a}_0+\hat{a}_1z^{-1}+\hat{a}_2z^{-2}+\ldots+\hat{a}_pz^{-p}$, and p is the order of said linear prediction filter.

2. The device according to claim 1, wherein said perceptually weighted filter with gain compensation includes a perceptually weighted filter and a gain compensation module.

3. The device according to claim 2, wherein said gain compensation module is disposed at the output of said perceptually weighted filter.

4. The device according to claim 2, wherein said gain compensation module is disposed at the input of said perceptually weighted filter.

5. A device according to claim 1, wherein said perceptually weighted filter with gain compensation includes a perceptually weighted filter incorporating gain compensation.

6. A hierarchical audio coder for use in a frequency band divided into adjacent first and second sub-bands, said coder comprising:

a core coder configured to code an original signal in a first sub-band of said frequency band;

a stage configured to calculate a residual signal from said original signal and the coded original signal from said core coder;

a perceptual weighting device configured to perceptually weight said residual signal;

wherein said perceptual weighting device includes a perceptually weighted filter with gain compensation, said perceptually weighted filter with gain compensation being in the form of $fac_1*\hat{A}_1(z/\gamma_1)/\hat{A}_1(z/\gamma_2)$ where $\hat{A}_1(z)$ represents a linear prediction filter, with $0\leqq\gamma_2\leqq1$ and $0\leqq\gamma_1\leqq1$, and $fac_1$ represents a gain compensation factor which is a function of coefficients of said linear prediction filter $\hat{A}_1(z)$, the gain compensation being adapted to realize spectral continuity between an output signal of said perceptually weighted filter with gain compensation and a signal in the second sub band, said gain compensation factor being given by:

$$fac_1 = \left| \frac{\sum_{i=0}^{p} (-\gamma_2)^i \hat{a}_i}{\sum_{i=0}^{p} (-\gamma_1)^i \hat{a}_i} \right|$$

where $\hat{a}_i$ are the coefficients of said linear prediction filter $\hat{A}_1(z)=\hat{a}_0+\hat{a}_1z^{-1}+\hat{a}_2z^{-2}+\ldots+\hat{a}_pz^{-p}$, and p is the order of said linear prediction filter.

7. The coder according to claim 6, wherein said perceptually weighted filter with gain compensation includes a perceptually weighted filter in the first sub-band.

8. The coder according to claim 6, wherein the coefficients of said linear prediction filter are supplied by said core coder.

9. The coder according to claim 6, wherein the signal from the perceptual weighting device in the first sub-band and the original signal in the second sub-band are applied to respective transform analysis modules and said transform analysis modules are connected to a transform coder in said frequency band.

10. The coder according to claim 6, wherein said coder includes also a second perceptual weighting device configured to perceptually weight the original signal in the second sub-band, comprising a second perceptually weighted filter with gain compensation adapted to realize spectral continuity between an output signal of said second perceptually weighted filter with gain compensation and the output signal of the perceptual weighting device in the first sub-band.

11. The coder according to claim 10, wherein said second perceptually weighted filter with gain compensation includes a perceptually weighted filter in the second sub-band.

12. The coder according to claim 11, wherein said second perceptually weighted filter in the second sub-band is of the form $\hat{A}_2(z/\gamma'_1)/\hat{A}_2(z/\gamma'_2)$ where $\hat{A}_2(z)$ represents a linear prediction filter and $0\leqq\gamma'_2\leqq1$ and $0\leqq\gamma'_1\leqq1$.

13. The coder according to claim 12, wherein said gain compensation in the second sub-band effects multiplication by a factor $fac_2$ equal to:

$$fac_2 = \left| \frac{\sum_{i=0}^{p} (\gamma'_2)^i \hat{a}'_i}{\sum_{i=0}^{p} (\gamma'_1)^i \hat{a}'_i} \right|$$

in which the $\hat{a}'_i$ are the coefficients of said linear prediction filter $\hat{A}_2(z)=\hat{a}'_0+\hat{a}'_1z^{-1}+\hat{a}'_2+\ldots+\hat{a}'_pz^{-p}$, and p is the order of said linear prediction filter.

14. The coder according to claim 12, wherein the coefficients of said linear prediction filter $\hat{A}_2(z)$ are supplied by a band expansion module.

15. The coder according to claim 10, wherein the signal from the perceptual weighting device in the first sub-band and the signal from the perceptual weighting device in the second sub-band are applied to respective transform analysis modules and said transform analysis modules are connected to a transform coder in said frequency band.

16. The coder according to claim 6, wherein said core coder is a linear prediction based coder.

17. The coder according to claim 16, wherein said core coder is a CELP coder.

18. A hierarchical audio decoder for use in a frequency band divided into adjacent first and second sub-bands, said decoder comprising:

a core decoder adapted to decode in the first sub-band of said frequency band a received signal coded by a core coder; and an inverse perceptual weighting device for inversely perceptually weighting a signal representing the residual signal weighted in the first sub-band by the perceptual weighting device of said coder;

wherein said inverse perceptual weighting device includes a perceptually weighted filter with gain compensation that is the inverse of the perceptually weighted filter with gain compensation of the coder in the first sub-band, wherein the perceptually weighted filter with gain compensation of the inverse perceptual weighting device is in the form $(1/fac_1)*\hat{A}_1(z/\gamma_2)/\hat{A}_1(z/\gamma_1)$ where $\hat{A}_1(z)$ represents a linear prediction filter, with $0\leqq\gamma_2\leqq1$ and $0\leqq\gamma_1\leqq1$, and $1/fac_1$ represents a gain compensation factor which is a function of coefficients of said linear prediction filter $\hat{A}_1(z)$, given by:

$$1/fac_1 = \left| \frac{\sum_{i=0}^{p} (-\gamma_1)^i \hat{a}_i}{\sum_{i=0}^{p} (-\gamma_2)^i \hat{a}_i} \right|$$

where $\hat{a}_i$ are the coefficients of said linear prediction filter $\hat{A}_1(z)=\hat{a}_0+\hat{a}_1z^{-1}+\hat{a}_2z^{-2}+\ldots+\hat{a}_pz^{-p}$, and p is the order of said linear prediction filter.

19. The decoder according to claim 18, wherein said decoder also includes a second inverse perceptual weighting device of the decoded signal in the second sub-band, comprising a second perceptually weighted filter with gain compensation that is the inverse of the perceptually weighted filter with gain compensation of the coder in the second sub-band.

20. The decoder according to claim 19, wherein said second perceptually weighted filter with gain compensation includes an inverse perceptually weighted filter in the second sub-band.

21. The decoder according to claim 20, wherein said second perceptually weighted filter in the second sub-band is of the form $\hat{A}_2(z/\gamma'_2)/\hat{A}_2(z/\gamma'_1)$, where $0\leqq\gamma'_2\leqq1$ and $0\leqq\gamma'_1\leqq1$.

22. The decoder according to claim 21, wherein the coefficients of the linear prediction filter $\hat{A}_{2(z)}$ are supplied by a band expansion module.

23. A perceptual weighting method of coding an audio signal in a given frequency band, said coding being effected in a plurality of adjacent sub-bands in said frequency band, wherein said method includes, in at least one sub-band of the plurality of adjacent sub-bands, a step of perceptual weighted filtering with gain compensation, said perceptual weighted filtering with gain compensation being in the form of $fac*\hat{A}(z/\gamma_1)/\hat{A}(z/\gamma_2)$ where $\hat{A}(z)$ represents a linear prediction filter, with $0\leqq\gamma_2\leqq1$ and $0\leqq\gamma_1\leqq1$, and fac represents a gain compensation factor which is a function of coefficients of said linear prediction filter $\hat{A}(z)$, the gain compensation being adapted to realize spectral continuity between an output signal of said perceptually weighted filter with gain compensation and signals in sub-bands adjacent to said at least one sub-band, said gain compensation factor fac being given by:

$$fac = \left| \frac{\sum_{i=0}^{p} (-\gamma_2)^i \hat{a}_i}{\sum_{i=0}^{p} (-\gamma_1)^i \hat{a}_i} \right|$$

where $\hat{a}_i$ are the coefficients of said linear prediction filter $\hat{A}(z)=\hat{a}_0+\hat{a}_1 z^{-1}+\hat{a}_2 z^{-2}+\ldots+\hat{a}_p z^{-p}$, and p is the order of said linear prediction filter.

24. A non-transitory computer-readable medium storing a computer program including a series of instructions for execution by a computer or a dedicated device, wherein execution of said instructions performs the perceptual weighting method according to claim 23.

* * * * *